US005437170A

United States Patent [19]

Nilsson et al.

[11] Patent Number: 5,437,170

[45] Date of Patent: Aug. 1, 1995

[54] WASHING APPARATUS

[75] Inventors: Mikael Nilsson; Bo Wilke, both of Karlstad, Sweden

[73] Assignee: Kvaerner Pulping Technologies AB, Karlstad, Sweden

[21] Appl. No.: 280,825

[22] Filed: Jul. 26, 1994

[30] Foreign Application Priority Data

Feb. 4, 1994 [SE] Sweden ..... 9400356-3

[51] Int. Cl.[6] ..... D21D 5/04

[52] U.S. Cl. ..... 68/181 R; 162/60

[58] Field of Search ..... 8/156; 68/181 R; 162/19, 60, 251

[56] References Cited

U.S. PATENT DOCUMENTS

| | | | |
|---|---|---|---|
| 1,953,076 | 4/1934 | Davies | 8/156 X |
| 4,232,416 | 11/1980 | Burgin | 162/60 X |
| 4,451,331 | 5/1984 | Raggam et al. | 162/19 X |
| 4,944,167 | 7/1990 | Jacobsen et al. | 68/181 R |
| 5,020,178 | 6/1991 | Jacobsen | 8/156 |
| 5,187,956 | 2/1993 | Phillips et al. | 68/181 R |

*Primary Examiner*—Philip R. Coe
*Attorney, Agent, or Firm*—Cushman Darby & Cushman

[57] ABSTRACT

Apparatus for treating pulp with a treating liquid, comprising a vessel (1) with cylindrical wall (2), inner screening means (3) for withdrawing liquid from the pulp, and a plurality of distributing tubes (5) on the outside of the vessel for the supply of treating liquid into the vessel through a plurality of inlet connections (6). According to the invention each distributing tube (5) is formed of an annular section (20) and an opposing part (21) of the cylinder wall (2), the section being welded directly to the cylinder wall, and the section and the cylinder wall part enclosing between them a distributing channel (22). Furthermore, each inlet connection (6) is provided with an opening (23) extending through the cylinder wall part and connecting the distribution channel to the interior of the vessel.

9 Claims, 4 Drawing Sheets

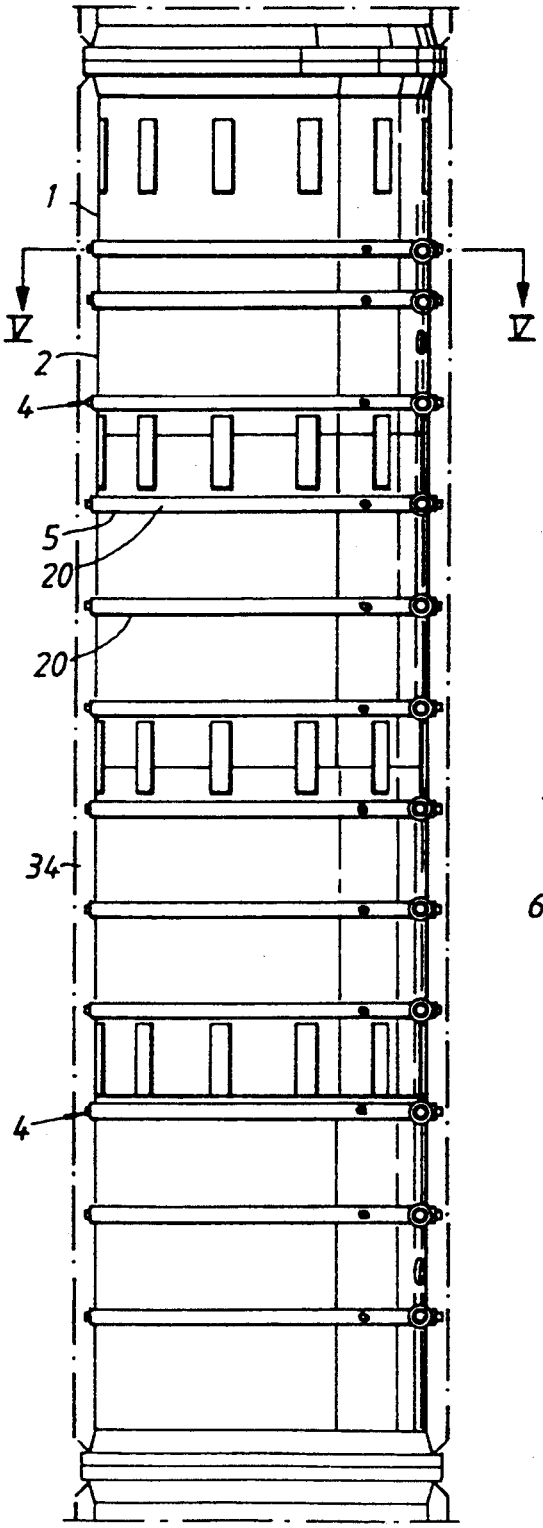
Fig. 4
Fig. 8
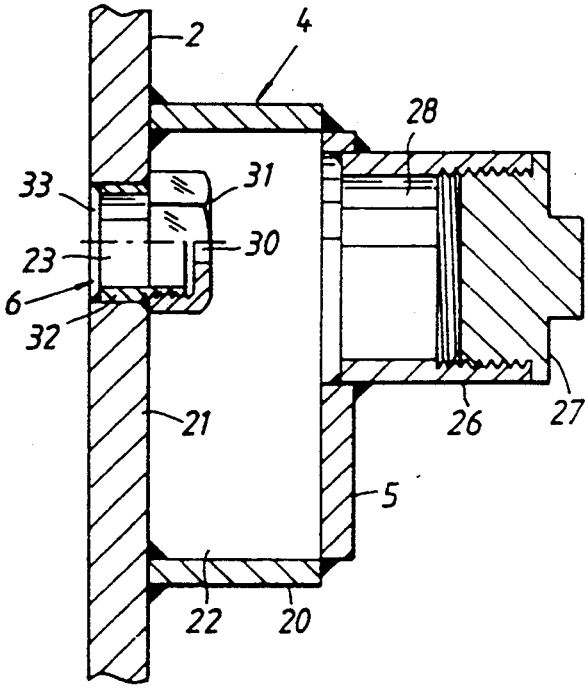

WASHING APPARATUS

FIELD AND BACKGROUND OF THE INVENTION

The present invention relates to apparatus for treating pulp of cellulosic fibre material with a treating liquid.

The distributing tubes used hitherto in apparatus of the type described are in the form of rings mounted with a space from the rotation-symmetrical wall of the vessel, which is usually cylindrical. The annular tubes communicate with the interior of the vessel via inlet connections, each having an inlet connection piece and a tube bend connected by means of a flange-bolt joint. It will be understood that such an arrangement, with annular tubes suspended outside the vessel requires extensive manufacture and assembly work, the inlet connection pieces having to be fitted into holes drilled in the cylinder wall, and welded to the cylinder wall before or after said flange-bolt joint is made. Fitting and welding the many different components is complicated. In order to obtain circular ring tubes they must be bent by means of a complicated induction technique requiring special equipment that is not usually available in workshops where the apparatus is manufactured. However, one of the main drawbacks is that the annular tubes and the inlet connections, comprising inlet connection pieces and tube bends, must be test-assembled at the workshop prior to delivery, after which the parts are dismantled and marked before being delivered to the relevant site where they are once again assembled in accordance with the markings made. Complicated and time-consuming work follows this final assembly in order to insulate the washing apparatus since each individual annular tube must be insulated and insulation must be applied to the cylinder wall inside the insulation around the annular tubes. Complicated insulation hoods with eccentric clamps must also be made and applied around the tube bends and adjacent flange-bolt joints. The insulation of the annular tubes and inlet connections is not sufficient and the annular tubes must be heated with electric current to prevent the treating liquid from freezing. Since the annular tubes have circular cross section it is difficult to connect a pipe socket with tangential or other inclined direction to the annular tubes and the pipe sockets must therefore be connected radially. This means that during operation liquid is distributed into the annular tube in both directions, thereby risking it becoming stationary at the diametrically opposite side, and fibres thus collecting there and either entirely or partially clogging the annular tube. Since the inlet connections are located above each annular tube, remaining liquid cannot be tapped from the system to the vessel when there is a stop in production.

SUMMARY OF THE INVENTION

The object of the present invention is to substantially reduce the above-mentioned problems and even entirely eliminate them in many cases, and to provide a washing apparatus with functionally and constructionally improved liquid supply means for treating liquids, that are simpler to manufacture and assemble than previously used liquid supply means, that can be assembled permanently on the vessel in the workshop prior to delivery, that enable simplified insulation of the vessel and liquid supply means, and that result in improved operating reliability.

The present invention relates to an apparatus for treating pulp of cellulosic fibre material with a treating liquid, said apparatus comprising a vertical vessel with rotation-symmetrical wall, screening means arranged in the vessel for withdrawing liquid from the pulp, and liquid supply means for the supply of said treating liquid to the vessel, said liquid supply means including a plurality of distributing tubes arranged concentrically on the outside of the vessel, and a plurality of inlet connections connecting each distributing tube to the vessel, each of said distributing tubes being formed of an annular section and an opposing part of the rotation-symmetrical wall, said annular section being welded directly to the rotation-symmetrical wall, said annular section and said wall part enclosing between them an endless, annular distributing channel, each of said inlet connections being provided with an opening extending through said wall part and connecting said distribution channel to the interior of the vessel.

BRIEF DESCRIPTION OF THE DRAWING

The invention will be described in more detail in the following with reference to the accompanying drawings.

FIG. 4 is a side view of a section of a pressure diffuser provided with liquid supply means in accordance with the present invention.

FIG. 8 is a section similar to that illustrated in FIG. 7 but showing a different embodiment of the inlet connection according to the invention.

DESCRIPTION OF ILLUSTRATED EMBODIMENT

Figure 1:
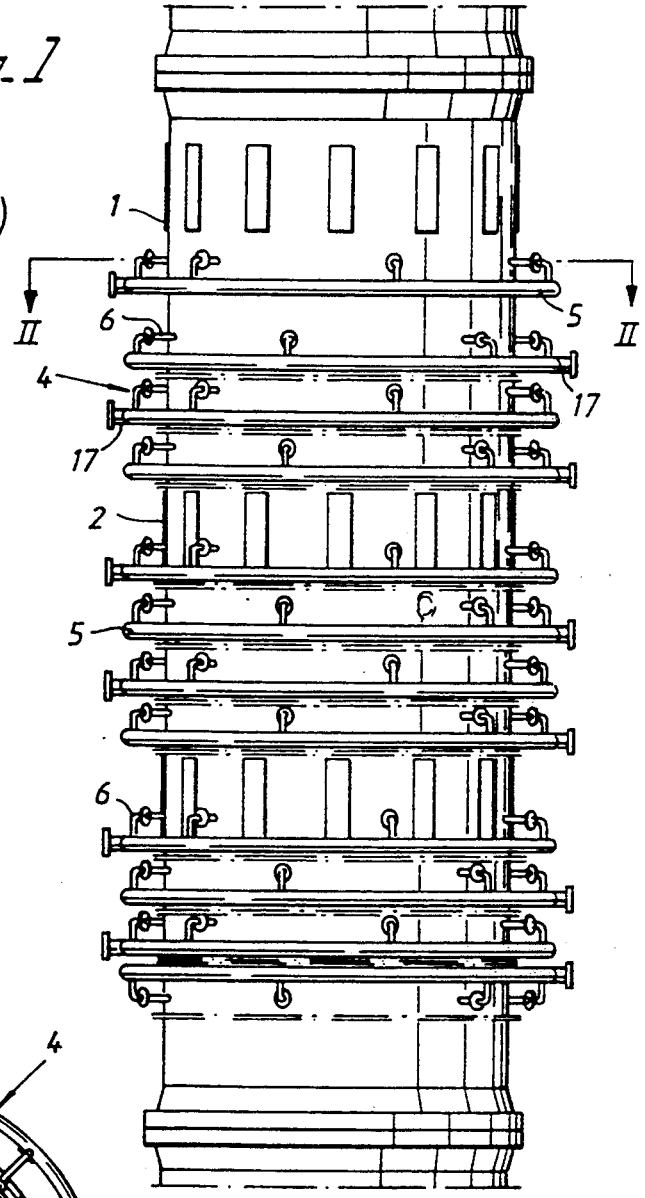
Fig. 1 (PRIOR ART)
FIG. 1 is a side view of a section of a pressure diffuser provided with liquid supply means in accordance with a known design.

FIG. 1 illustrates schematically a section of a washing apparatus of the pressure diffuser type for treating pulp of medium consistency, 6–18%. The washing apparatus has a closed, vertical vessel 1 with rotation-symmetrical wall 2. In the embodiment shown this wall is cylindrical but may be differently shaped if desired, e.g. conical. Such a washing apparatus of normal size has a cylindrical wall with a diameter exceeding 1 m, usually being about 2–3 m. The pulp flows from an upper inlet to a lower outlet (not shown) in the vessel 1. A screening means 3 is arranged concentrically inside the vessel 1 to withdraw liquid from the pulp as it passes the screen surfaces of the screening means 3, the liquid withdrawn being removed from the vessel via one or more outlets (not shown).

Liquid supply means 4 are provided on the outside of the vessel to supply the pulp with a suitable treating liquid that replaces or displaces an equivalent quantity of the liquid phase in the pulp through the screening means 3. These liquid supply means 4 include a plurality of annular distributing tubes 5 (e.g. twelve), arranged concentrically outside and spaced from the cylinder wall 2. Each distributing tube 5 communicates with the interior of the vessel 1 via a plurality of inlet connections 6 also serving as support and assembly elements to secure the distributing tubes 5 to the cylinder wall 2.

Each inlet connection 6 includes a pipe bend 7 and a radially directed pipe socket 8 which is received in a hole 9 in the cylinder wall 2 and is welded to the cylinder wall 2. The pipe bend 7 and pipe socket 8 are rigidly joined together by a flange-bolt joint 10. A small sleeve 16 is welded to the pipe bend 7 to provide a straight cleaning opening into the pipe socket 8 when a closure has been removed from the sleeve 16. The pipe bend 7 and flange-bolt joint 10 are enclosed by a removable insulating hood 11. Treating liquid is pumped into the distributing tube 5 through a pipe socket 17 directed radially to the distributing tube 5 so that the treating liquid is distributed to the inlet connections 6 in both directions. 12 denotes insulation surrounding the distribution tube 5, and 13 denotes insulation surrounding the cylinder wall 2. A plurality of shields 14 are arranged on the inside of the vessel 1 for internal distribution of the treating liquid flowing in through each horizontal group of inlet connections 6, and on through each annular space 15 defined by the shield 14.

Figure 2:
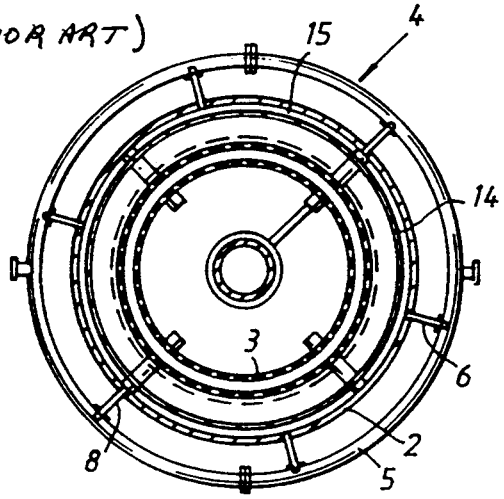
Fig. 2 (PRIOR ART)
FIG. 2 is a section along the line II—II in FIG. 1.
Figure 3:
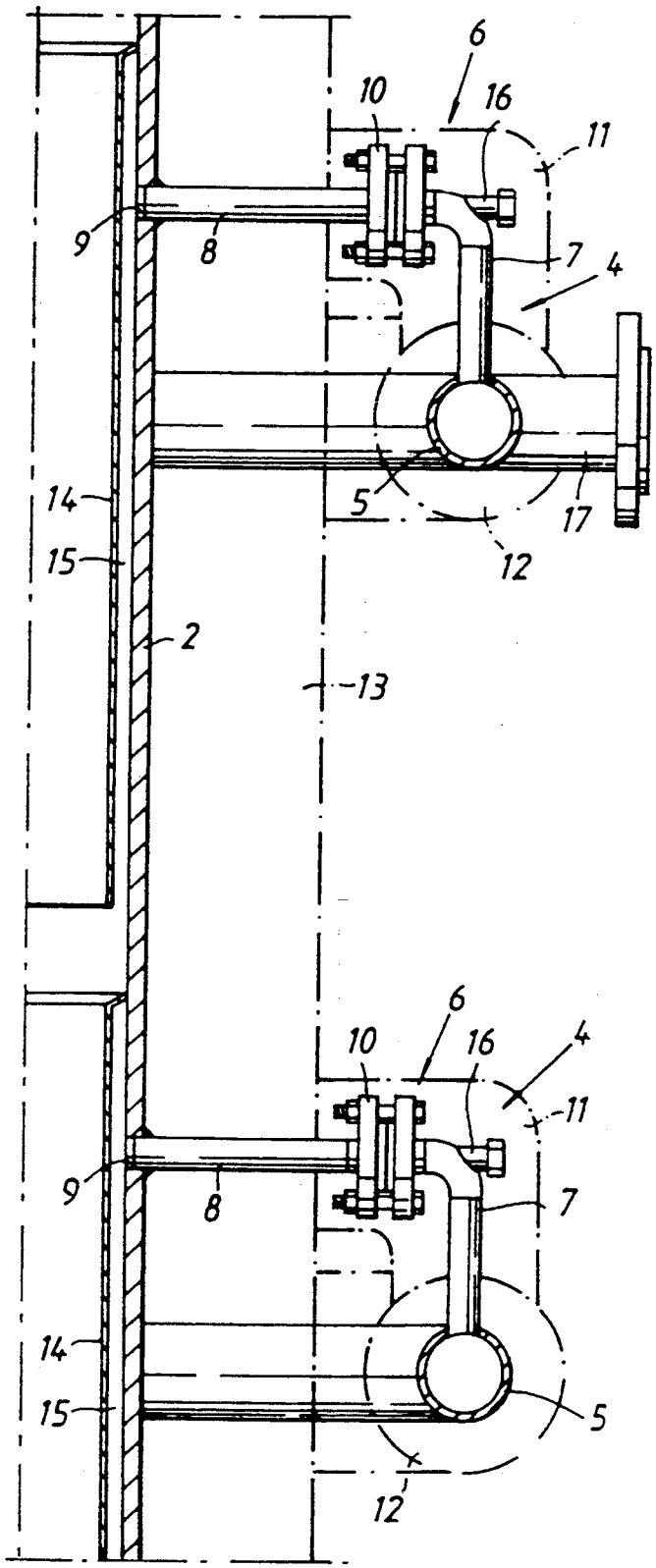
Fig. 3 (PRIOR ART)
FIG. 3 is a view showing parts of two adjacent liquid supply means in a pressure diffuser according to FIG. 1.

The embodiment of the liquid supply means 4 described above and illustrated in FIGS. 1–3 is the one that has been generally used hitherto and that has a number of disadvantages as discussed in the introduction.

Figure 5:
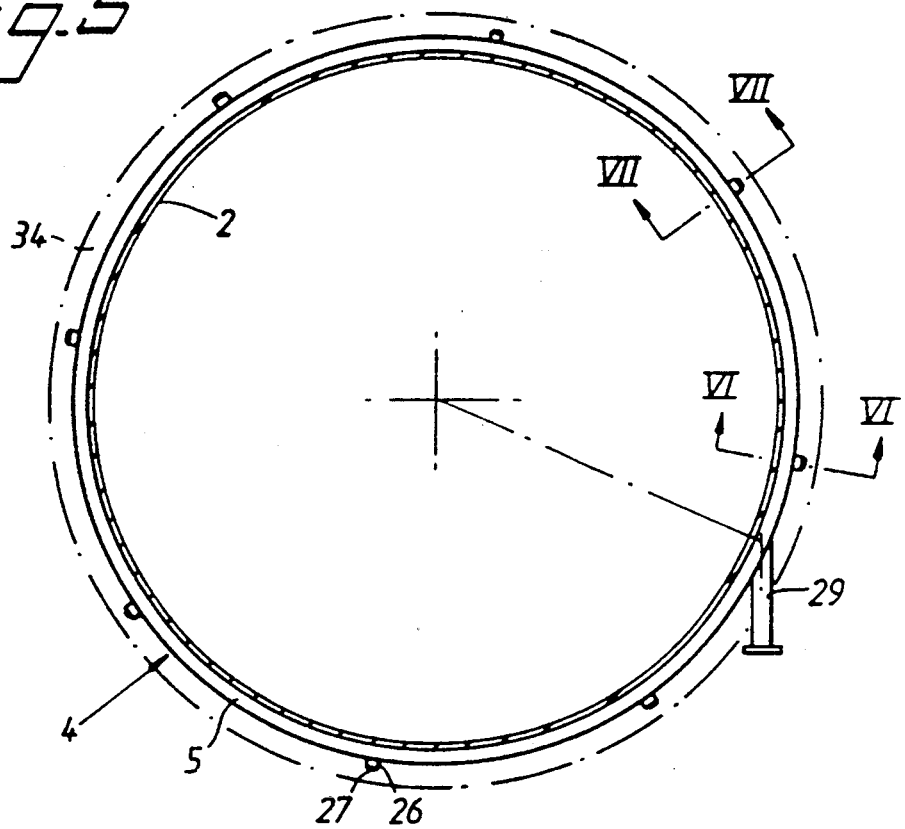
FIG. 5 is a section along the line V—V in FIG. 4.

FIG. 4 shows schematically a section of a similar washing apparatus provided with liquid supply means 4 constructed in accordance with the present invention. The construction of the washing apparatus itself is in principle the same as that shown in FIG. 1 and the same designations are therefore used for equivalent or similar construction elements or for construction elements having the same function. In the sectional view according to FIG. 5, however, the screening means has been omitted for the sake of simplicity.

Here too the liquid supply means 4 for the supply of treating liquid include a plurality of distributing tubes 5. However, according to the invention, these are designed and arranged in a completely different manner. According to the invention, thus, each distributing tube 5 is formed by a radially inwardly open section 20 and an opposing part 21 of the cylinder wall 2, the section 20 being welded directly to the cylinder wall 2 so that the section 20 and cylinder wall part 21 between them enclose an annular, concentric distribution channel 22. The liquid supply means 4 also comprise a plurality of inlet connections 6 which, according to the present invention, are provided with radial openings 23 extending through the cylinder wall part 21 and connecting the distribution channel 22 with the interior of the vessel 1 which includes the vertical annular space 15 defined by the shield 14. All form of external pipe laying is eliminated since the distributing tube 5 abuts directly against the outside of the cylinder wall 2.

In the simplest embodiment each such opening is formed by a radial hole drilled in the cylinder wall part 21. However, this embodiment can only be used in cases when the operating conditions are well known for the production in question and for the pressure conditions in the distribution channel and interior of the vessel so that the drill hole can be given the correct dimension right from the start to enable the same quantity of treating liquid to be fed in per time unit through all drill holes leading from one and the same distribution channel 22. If the diameter of the drill hole is intentionally or unintentionally too large the opening may include a throttle, e.g. the drill hole may be covered by a washer with a central hole having a smaller diameter than the drill hole. Such washers can easily be replaced from a stock of washers with various hole diameters, to enable throttling to be adjusted to the operating conditions prevailing.

Figure 6:
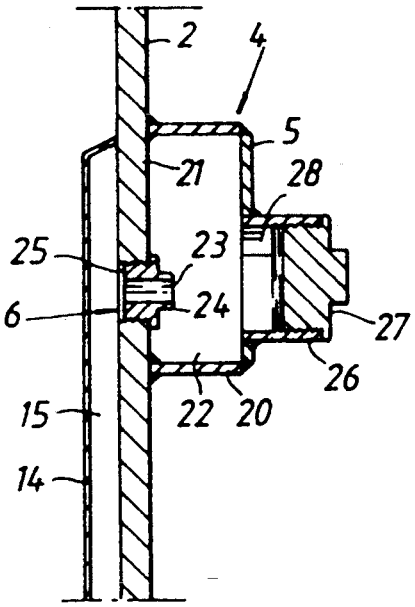
FIG. 6 is a section along the line VI—VI in FIG. 5.
Figure 7:
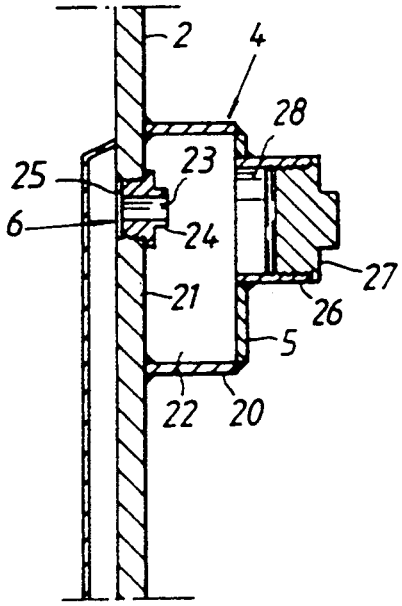
FIG. 7 is a section along the line VII—VII in FIG. 5.

In the embodiment shown in FIGS. 6 and 7 each opening 23 is formed by the central opening of a sleeve 24 screwed into a threaded drill hole 25 in the cylinder wall part 21. Similarly to the washer described above, the sleeve 24 can easily be replaced by other sleeves with central opening 23 of different diameter, thereby enabling adjustment to the prevailing operating conditions and the same amount of treating liquid will finally be fed in from the distribution channel per time unit through all sleeves 24 having the same diameter of central opening. Aligned with each opening 23 the outer vertical wall of the section is provided with a sleeve 26 closable by means of a plug 27 that can be screwed into the sleeve. When the plug 27 is removed the distribution channel 22 and sleeve 26 become accessible via the aperture 28 of the sleeve 26 and a tool can be inserted through the aperture 28 to remove and replace the inner sleeve 24. The distribution channel 22 and opening 23 can also be cleared of clogging fibres via this sleeve 26 if necessary.

Each distributing tube 5 is provided externally with an inlet connection piece 29 which is connected to a source of treating liquid via a pipe (not shown), the inlet connection piece being directed obliquely towards the outer circumference of the section 20 in a tangential or substantially tangential relationship where the chord intersecting the outer circle encloses a sector angle of from 0° (i.e. tangential relationship) to about 50°. In the embodiment shown in FIG. 5 this sector angle is about 47°. Arranging the inlet connection piece 29 obliquely to the distributing tube 5 causes the treating liquid to flow through the distribution channel 22 in only one direction, thereby preventing the appearance of a stationary pool of liquid and greatly reducing the risk of fibre clogging.

It is preferred that the cross section of the section 20 is rectangular, as shown in FIGS. 6 and 7. It is suitably built directly on the cylinder wall by welding two plates sectionwise at right angles to the cylinder wall at a predetermined distance from each other and then welding a plate sectionwise to the outer edges of the two plates already welded on. The rectangular shape of the distributing tube 5 is also advantageous since it enables the inlet connection piece 29 to be securely welded with inclination to the flat outer plate and also allow a good, symmetrical flow profile.

It is preferred to arrange the openings 23 alternately on the lower and upper parts of the distribution channel 22, as shown in FIGS. 6 and 7, respectively. Owing to the upper openings 23 deaeration of the distribution channel 22 can be carried out therethrough during operation. Owing to the lower openings 23 the removal of fibres is facilitated therethrough during operation. The entire distribution 22 is thus accessible at every cross section for the receipt and distribution of treating liquid.

FIG. 8 shows another embodiment of the inlet connection 6, where the opening 23 includes a throttle formed by a central aperture 30 in a replaceable throttle nut 31 screwed onto an externally threaded sleeve 32 received in a drill hole 33 in the cylinder wall part 21 and welded thereto. This throttle nut 31 can easily be replaced via the aperture 28, after removal of the plug 27, by a throttle nut having a central aperture 30 of different diameter.

Constructing the liquid supply means in accordance with the present invention entails considerably lower manufacturing costs and the washing apparatus is more compact and therefore requires less space, as can be seen from a comparison between FIGS. 1 and 4. The insulation 34 is simplified and the internal, protected location of the openings 23, i.e. in the cylinder wall part 21, makes electric heating of the distribution channel 22 unnecessary. The invention also enables simplification of the top of the washing apparatus so that a plastic hood used previously can be replaced by a simple system of beams and insulating plate. Another advantage is that the lower openings 23 allow most of the liquid in the distribution channels 22 to be automatically emptied into the vessel when the washing apparatus is shut down for service or some other stop in production.

That which is claimed is:

1. Apparatus for treating pulp of cellulosic fibre material with a treating liquid, said apparatus comprising a vertical vessel with rotation-symmetrical wall, screening means arranged in the vessel for withdrawing liquid from the pulp, and liquid supply means for the supply of said treating liquid to the vessel, said liquid supply means including a plurality of distributing tubes arranged concentrically on the outside of the vessel, and a plurality of inlet connections connecting each distributing tube to the vessel, each of said distributing tubes being formed of an annular section and an opposing part of the rotation-symmetrical wall, said annular section being welded directly to the rotation-symmetrical wall, said annular section and said wall part enclosing between them an endless, annular distributing channel, each of said inlet connections being provided with an opening extending through said wall part and connecting said distribution channel to the interior of the vessel.

2. Apparatus as claimed in claim 1 wherein the cross section of said annular section is rectangular.

3. Apparatus as claimed in claim 1 wherein said inlet connection comprises a sleeve, the central aperture of which forms said opening.

4. Apparatus as claimed in claim 3 wherein said sleeve is replaceable by a sleeve, said central opening of which having a different diameter.

5. Apparatus as claimed in claim 1 wherein said opening includes a throttle.

6. Apparatus as claimed in claim 5 wherein said inlet connection comprises a fixed sleeve, and said throttle is formed by a throttle nut, supported by said sleeve, whereby said opening is formed by the coaxial central openings of said sleeve and throttle nut.

7. Apparatus as claimed in claim 6 wherein said throttle nut is replaceable by a throttle nut having a central opening with a different diameter.

8. Apparatus as claimed in claim 1 wherein said liquid supply means includes an inlet connecting piece, secured to the distributing tube and inclined towards the distributing tube in its plane.

9. Apparatus as claimed in claim 1 wherein a first group of said openings, preferably alternate openings, is arranged in the lower portion of the distribution channel, and a second group of said openings, preferably alternate openings, is arranged in the upper portion of the distribution channel.

* * * * *